US011339781B2

(12) United States Patent
Deichmann et al.

(10) Patent No.: US 11,339,781 B2
(45) Date of Patent: May 24, 2022

(54) SCREW SPINDLE PUMP, FUEL PUMP ASSEMBLY, AND FUEL PUMP UNIT

(71) Applicant: Vitesco Technologies GmbH, Hannover (DE)

(72) Inventors: Johannes Deichmann, Rotenburg (DE); Tim Gonnermann, Wehretal (DE); Norbert Fernau, Nentershausen (DE); Bernd Jäger, Fritzlar (DE)

(73) Assignee: Vitesco Technologies GmbH, Hannover (DE)

( * ) Notice: Subject to any disclaimer, the term of this patent is extended or adjusted under 35 U.S.C. 154(b) by 208 days.

(21) Appl. No.: 16/625,549

(22) PCT Filed: Jun. 25, 2018

(86) PCT No.: PCT/EP2018/066953

§ 371 (c)(1),
(2) Date: Dec. 20, 2019

(87) PCT Pub. No.: WO2019/002206

PCT Pub. Date: Jan. 3, 2019

(65) Prior Publication Data

US 2021/0239114 A1 Aug. 5, 2021

(30) Foreign Application Priority Data

Jun. 27, 2017 (DE) ..... 10 2017 210 770.7

(51) Int. Cl.

| | |
|---|---|
| ***F01C 1/16*** | (2006.01) |
| ***F03C 2/00*** | (2006.01) |
| ***F03C 4/00*** | (2006.01) |
| ***F04C 18/00*** | (2006.01) |

(Continued)

(52) U.S. Cl.
CPC ..... *F04C 2/16* (2013.01); *F04C 11/008* (2013.01); *F04C 15/0073* (2013.01);
(Continued)

(58) Field of Classification Search
CPC .. F04C 2/082; F04C 2/16; F04C 2/165; F04C 11/008; F04C 15/0042; F04C 15/0073;
(Continued)

(56) References Cited

U.S. PATENT DOCUMENTS 3,097,359 A * 7/1963 Cowles et al. ..... F04C 18/16 418/203
4,940,394 A * 7/1990 Gibbons ..... F04C 13/002 418/134

(Continued)

FOREIGN PATENT DOCUMENTS

CN 1550658 12/2004
CN 1894508 1/2007

(Continued)

OTHER PUBLICATIONS

Office Action dated Mar. 31, 2021 issued in Chinese Patent Application No. 201880037739.6.

(Continued)

*Primary Examiner* — Theresa Trieu
(74) *Attorney, Agent, or Firm* — Cozen O'Connor

(57) ABSTRACT

A screw-spindle pump stage having a drive spindle and a running spindle which runs opposite the drive spindle and a pump housing for receiving the two screw spindles. The pump housing 16 has an offset interface with centering action, for a statically determined coupling to an electric motor. The pump housing has an offset section functioning as an abutment, which is able to be abutted against the electric motor for the application of an axial preload. At least one pressure region of the abutment section, which is close to the interface and, during a rolling, is encapsulated, and at the same time sealingly enclosed, by a sheet-metal casing, forms a rolling region of the pump, the screw spindles, together with the associated pump housing section, at least (Continued)

partially project from the rolling region of the pump on the suction side.

19 Claims, 5 Drawing Sheets

(51) Int. Cl.
*F04C 2/16* (2006.01)
*F04C 11/00* (2006.01)
*F04C 15/00* (2006.01)

(52) U.S. Cl.
CPC .. *F04C 2210/1044* (2013.01); *F04C 2240/20* (2013.01); *F04C 2240/30* (2013.01); *F04C 2240/40* (2013.01)

(58) Field of Classification Search
CPC ..... F04C 2210/1044; F04C 2240/20; F04C 2240/30; F04C 2240/40
See application file for complete search history.

(56) References Cited

U.S. PATENT DOCUMENTS

| | | | | |
|---|---|---|---|---|
| 2004/0241016 | A1* | 12/2004 | Beaven | F04C 15/008 417/410.4 |
| 2009/0255515 | A1* | 10/2009 | Eck | F02M 37/106 123/509 |
| 2010/0092317 | A1 | 4/2010 | Heishin | |
| 2013/0236334 | A1 | 9/2013 | Tang | |
| 2015/0240810 | A1* | 8/2015 | Metz | F04C 2/16 418/201.1 |

FOREIGN PATENT DOCUMENTS

| | | | | |
|---|---|---|---|---|
| CN | 101176250 | | 5/2008 | |
| CN | 105840498 | | 8/2016 | |
| DE | 4123384 | | 1/1993 | |
| DE | 4308755 | A1 * | 9/1994 | F16D 1/101 |
| DE | 10311037 | | 11/2003 | |
| DE | 102011001041 | | 5/2012 | |
| DE | 102015101443 | | 5/2016 | |
| GB | 2401396 | | 11/2004 | |

OTHER PUBLICATIONS

Office Action for the corresponding German Patent Application No. 10 2017 210 770.7.

* cited by examiner

SCREW SPINDLE PUMP, FUEL PUMP ASSEMBLY, AND FUEL PUMP UNIT

CROSS REFERENCE TO RELATED APPLICATIONS

This is a U.S. national stage of Application No. PCT/EP2018/066953 filed Jun. 25, 2018. Priority is claimed on German Application No. DE 10 2017 210 770.7 filed Jun. 27, 2017 the content of which is incorporated herein by reference.

BACKGROUND OF THE INVENTION

Field of the Invention

The present invention relates to a screw-spindle pump, a fuel delivery assembly comprising such a screw-spindle pump, and to a fuel delivery unit comprising such a fuel delivery assembly, for use in vehicles, in particular in passenger motor vehicles and/or utility vehicles.

2. Description of the Prior Art

Screw-spindle pumps, also referred to as screw pumps, are positive displacement pumps having displacement elements formed as a spindle screw. Two oppositely running screw spindles formed with a threaded profiling engage into one another here and displace a delivery medium, which may for example be a fuel, for example gasoline or diesel fuel, for an internal combustion engine of a passenger motor vehicle and/or a utility vehicle. The combination of the spindle screws and a pump housing in which the screw spindles are arranged and guided is referred to as a pump stage. The two screw spindles form, in combination with the pump housing, delivery chambers for the delivery medium. The delivery chambers travel from a suction side or inlet side to a pressure side or outlet side of the pump or pump stage as a consequence of a rotation of the screw spindles.

Within the context of the present disclosure, the terms pump and pump stage are to be understood as meaning one and the same object.

Pumps of this type are used for example in fuel delivery assemblies or fuel pumps of vehicles, in particular of passenger motor vehicles and/or utility vehicles. Within the context of the present disclosure, the terms fuel delivery assembly and fuel pump are to be understood as meaning one and the same object, which, in addition to a pump or pump stage, also comprises an electric motor as a drive.

A fuel delivery assembly according to the prior art, in addition to such a pump, also comprises an electric motor that drives the pump. The electric motor and the pump are rolled together with a sheet-metal casing or sheet-metal cylinder, which substantially encapsulates, and at the same time sealingly encloses, both the electric motor and the pump. An interface, formed on the pressure side with respect to the pump, to the electric motor, on the one hand, and an arrangement, on the suction side with respect to the pump, of an axially acting seal or axial seal, on the other hand, influence a constraint or bracing of the pump that is established during the rolling of the sheet-metal casing. Here, this bracing extends over the entire pump and leads to a statically overdeterminate or indeterminate installation situation of the pump.

The axial seal is in this case arranged on the suction side between the pump housing and a pump cover. Such an axial seal is subjected to the length tolerances in an axial direction of all installed elements, which are to be taken into consideration for the dimensioning of the axial seal.

SUMMARY OF THE INVENTION

An object of one aspect of the invention is to provide a pump which, in a state installed together with an electric motor to form a fuel delivery assembly, permits a statically determined installation position of the pump.

One aspect of the invention is to provide a pump that takes up less installation space and makes possible both saving of weight and saving of costs.

One aspect of the invention is a screw-spindle pump stage, comprising:

- at least two screw spindles, which comprise a drive spindle and a running spindle that runs oppositely with respect to the drive spindle; and
- a pump housing for receiving the two screw spindles.

Here, the two screw spindles form, at least in combination with the pump housing, delivery chambers, which move from a suction side or inlet side to a pressure side or outlet side of the pump as a consequence of a rotation of the screw spindles. Or, put differently, the delivery chambers move in the direction of the pressure side of the pump as a consequence of a rotation of the screw spindles.

In principle, it would also be possible for such screw spindles to form the delivery chambers in combination with a pump housing, with a pump cover and possibly with an additional element or insert element, wherein said additional element may be arranged within the pump housing and/or the pump cover.

The pump housing is in this case provided on the pressure side with an offset interface with centering action, for a statically determined coupling to an electric motor, wherein formed on the pump housing on the pressure side is an offset section functioning as an abutment, which is able to be abutted against the electric motor, preferably in a planar manner, for the application of an axial preload. Here, at least one pressure region of the abutment section, which is close to the interface and, during a rolling, is encapsulated, and at the same time sealingly enclosed, by a sheet-metal casing, forms a rolling region of the pump. Here, the screw spindles, together with the associated pump housing section, at least partially project from the rolling region of the pump on the suction side.

Within the context of the present disclosure, the rolling region of the pump is to be understood as that region of the pump that is encapsulated by the rolling of the pump with the electric motor by a sheet-metal casing or sheet-metal cylinder. This rolling region accordingly also comprises that region of the pump in which the sheet-metal casing or sheet-metal cylinder is bent over against the pump and in the process plastically deformed.

A statically determined installation position of the pump with respect to the electric motor can be fixed as a result of the axial preload acting on the abutment section of the pump housing (in a state installed together with the electric motor to form a fuel delivery assembly). The statically determined installation position of the pump is in turn ensured by the interface with centering action.

The proposed screw-spindle pump allows the rolling region of the pump to be reduced in size such that use may be made of sheet-metal casing or sheet-metal cylinder lengths, which are also used in side-channel impeller and/or peripheral impeller pumps. This in turn helps to reduce parts variety, and furthermore permits access to an existing modular system for side-channel impeller and/or peripheral impeller pumps.

The statically determined coupling capacity of the pump interface section to the electric motor, which makes possible the statically determined installation position of the pump with respect to the electric motor, furthermore forms the basis for further advantageous configurations or embodiments of aspects of the invention, as will be shown below.

Such a pump interface is also associated with a reduction in structure-borne sound-induced noise generation or sound emissions, which, when the pump stage is used in a vehicle, can be perceived by vehicle occupants.

According to one embodiment, an outer rib collar, with at least two or three centering ribs for insertion into a centering seat of the electric motor, is formed on a projecting interface section of the pump, which interface section has centering action. Said interface section permits by its centering section, in the form of the centering ribs, the joining of the pump to the electric motor, with the result that, following the joining, said axial preload is able to be applied by the abutment section of the pump housing. As a result of the axial preload, said statically determined installation position of the pump with respect to the electric motor is fixed.

In a further embodiment, an offset orientation rib section for the angular orientation of the pump housing with respect to the electric motor is formed on one of the centering ribs in a radial direction. Here, the orientation rib section is able to be inserted into a corresponding recess of the centering seat of the electric motor. In this way, a unique angular orientation is ensured by an orientation section in the form of the orientation rib section.

In a further embodiment, the pump or pump stage may furthermore comprise a pump cover, which abuts against the pressure-side abutment section of the pump housing. The pump cover may in this case be regarded as a part for receiving the screw spindles that belongs to the pump housing. Here, the abutment section forms, in combination with a pressure region of the pump cover, which is close to the interface and, during a rolling with a sheet-metal casing (also referred to as a sheet-metal cylinder), is encapsulated, and at the same time sealingly enclosed, by the sheet-metal casing, the rolling region of the pump, wherein the screw spindles, together with the associated pump housing section and pump cover section, at least partially project from the rolling region of the pump on the suction side.

As a result of the statically determined installation position of the pump, it is possible, in contrast to the prior art,—to reduce to a pressure region that is close to the interface and which, during a rolling, is encapsulated, and at the same time sealingly enclosed, by a corresponding sheet-metal casing or sheet-metal cylinder the constraints or bracings that are established in the pump housing as a consequence of a rolling of the pump housing, together with the pump cover, with the electric motor.

In such an embodiment, the pump cover may provide an abutment surface for the two screw spindles, with the result that, in addition to the pump housing, the pump cover also contributes to the receiving of the two screw spindles.

In this case, according to a further embodiment, between the pump housing and the pump cover, there may advantageously be arranged a first radial seal, which firstly acts sealingly with respect to a delivery medium, and secondly centers the pump cover with respect to the pump housing in a floating manner.

Such a floating centering in this case promotes said statically determined installation position of the pump in that it ensures a spacing between the pump housing and the pump cover, such that contact-induced constraints or bracings in the pump housing on account of the rolling do not occur.

The floating centering furthermore helps to make it possible for the length of the rolling region of the pump, with the pump cover, to be reduced, wherein the rolling region is shortened toward the pressure side. This results in less sheet-metal material being required for the rolling. The shortening of the rolling region in turn makes possible the utilization of the aforementioned modular system for side-channel impeller and/or peripheral impeller pumps, such that use may be made of sheet-metal casing lengths which are also used in side-channel impeller and/or peripheral impeller pumps.

The shortening of the rolling region also contributes to a shorter design of the pump and thus to saving of installation space and to saving of costs and weight.

According to one aspect of the pump, which does not require a pump cover, on at least one end side of the abutment section, there is formed at least one abutment element that projects in the longitudinal direction of the pump or pump stage, which is preferably planar in a peripheral direction.

According to a further aspect of the pump, which comprises a pump cover, abutment elements of said type are provided on two end sides of the abutment section. Here, both end sides each have at least one projecting abutment element, which is preferably planar in a peripheral direction.

Here, the abutment element extends as a circular or part-circular segment either over the entire periphery of the abutment section or only over part of the periphery of the abutment section. In the latter case, multiple, or at least two or three, abutment elements or abutment segments are provided so as to be distributed over the periphery, which abutment elements or abutment segments ensure a planar abutment of the abutment section with respect to the electric motor and, if the pump also comprises a pump cover in addition to a pump housing, a planar abutment of the pump cover with respect to the abutment section.

Abutment elements of this type constitute defined force introduction regions for application of the axial preload. Abutment elements which are planar or are formed in a planar manner also ensure that tilting of the pump with respect to the electric motor and/or tilting of the pump cover with respect to the pump do/does not occur, with the result that the constraints or bracings which result therefrom as a consequence of the rolling also do not occur.

In principle, multiple, preferably at least three, abutment elements of this type may be formed so as to be distributed over the periphery of the abutment section. In this case, with respect to an end side of the abutment section, the abutment elements may expediently be uniformly spaced apart from one another, wherein the abutment elements on both end sides of the abutment section, according to a pump with cover, preferably correspond to one another with respect to their position, in order to promote the force introduction or directing-through of the preload.

Such a uniform arrangement of the abutment elements over the periphery of the abutment section of the pump causes the preload to be directed through into the motor-side pump interface in an effective and uniform manner.

According to a further aspect, the abutment section of the pump may be of circular ring-shaped form and be formed on a core of the pump housing via an inner rib collar with multiple, preferably at least three or at least six, ribs. Such an embodiment contributes to saving of material and weight.

According to a further aspect, it is also possible for a second radial seal to be arranged with a radial spacing, and so as to be situated outwardly, with respect to the first radial seal, which may be arranged on an inner side of the pump cover, on an outer side of the pump cover, which outer side is able to be rolled together with a sheet-metal casing. Said second radial seal likewise acts sealingly with respect to the delivery medium. Here, the first and second radial seals together form a parallel seal arrangement with respect to the delivery medium.

The first radial seal may be arranged here on an inner side of an inner peripheral projection of the pump cover. By contrast, the second radial seal may be arranged here on an outer side of an outer peripheral projection of the pump cover.

This makes it possible to save material for the pump cover between the first radial seal and the second radial seal, or the inner and outer projections. This also contributes to saving of costs and weight.

The first radial seal may furthermore be arranged within a region of the pump that is to be rolled together with the sheet-metal casing.

The first and/or the second radial seal may be formed as round cord rings/a round cord ring or O-rings/an O-ring, for example in the form of an elastomer O-ring.

By contrast to elastomer O-rings, round cord rings are sealing rings that are produced from a round cord and adhesively bonded, or vulcanized, in a butt-jointed manner. The round cord may in this case be extruded. This necessarily results in a joint position on the periphery at which the ends of the round cord are adhesively bonded or vulcanized.

For production reasons, on the one hand, and for saving weight, on the other hand, it is proposed to form the pump or the pump housing and/or the pump cover as injection moldings/an injection molding.

Furthermore, a fuel delivery assembly having an electric motor and having a screw-spindle pump of the aforementioned type which is driven by the electric motor is proposed, wherein the installation position of the pump with respect to the electric motor is statically determined.

According to one aspect, the electric motor and the screw-spindle pump are rolled together with a sheet-metal casing, which encapsulates the electric motor completely or substantially completely and the pump or pump stage only partially.

A fuel delivery unit for use in a fuel tank of a vehicle is also proposed. A "vehicle" is to be understood here as meaning any type of vehicle which has to be supplied with a liquid and/or gaseous fuel for operation, but in particular passenger motor vehicles and/or utility vehicles.

Here, the fuel delivery unit comprises a fuel delivery assembly of the above-described type, and a swirl pot in which the fuel delivery assembly is arranged in order for fuel to be delivered from the swirl pot to an internal combustion engine.

BRIEF DESCRIPTION OF THE DRAWINGS

The invention will be discussed in detail in the following text with reference to the illustrations in the figures. Further advantageous refinements of the invention emerge from the dependent claims and the description below of preferred embodiments. In the drawings:

DETAILED DESCRIPTION OF THE PRESENTLY PREFERRED EMBODIMENTS

Figure 1:
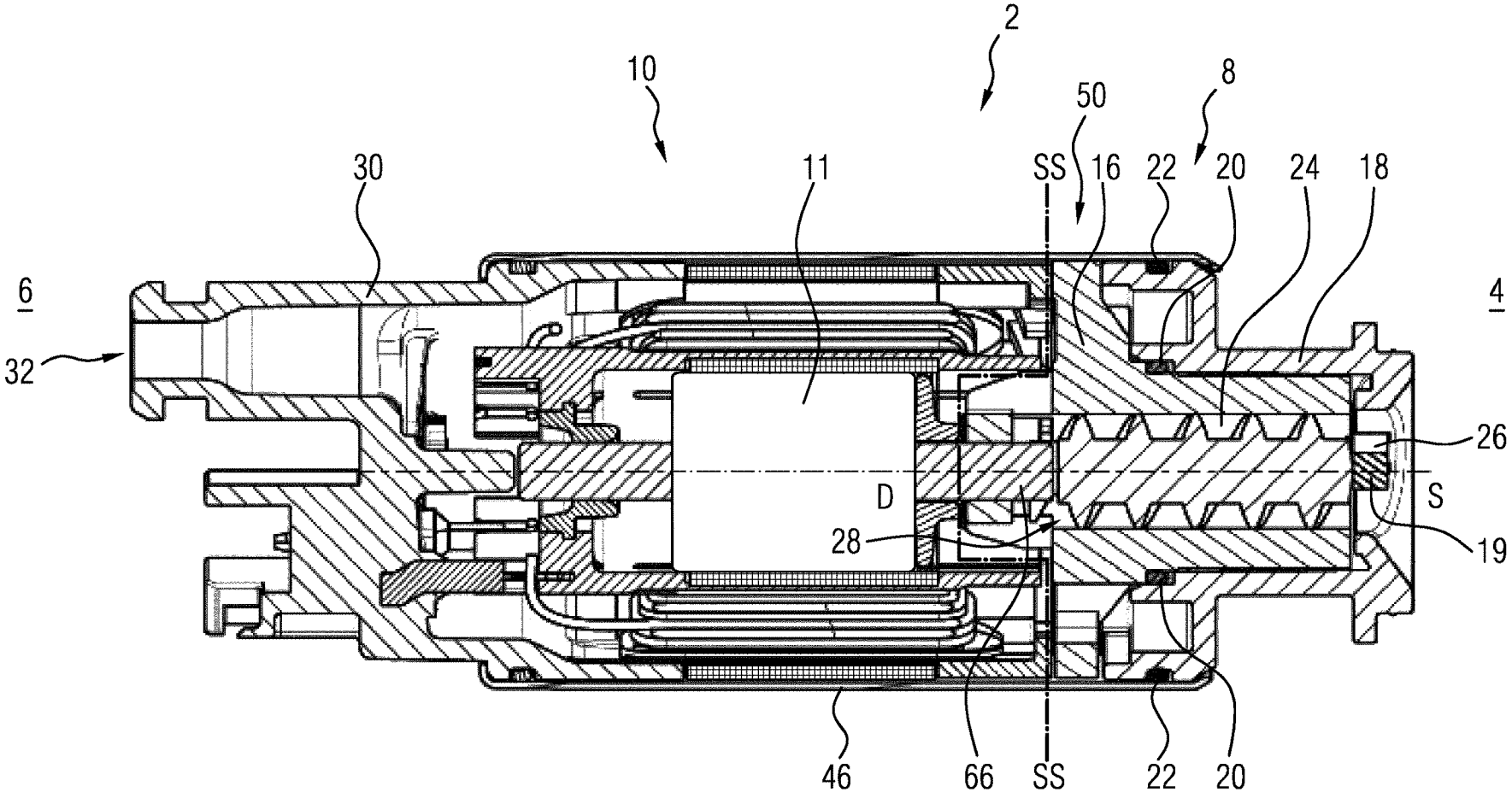
FIG. 1 is a fuel delivery assembly with a pump installed in a statically determined manner.
Figure 4:
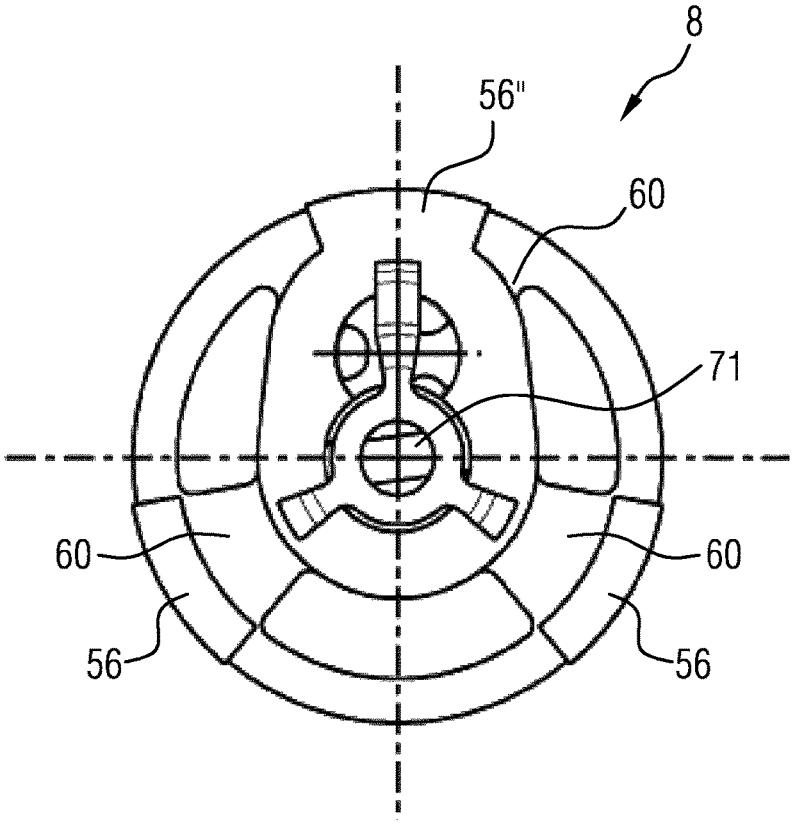
FIG. 4 is a front view of the pump housing shown in FIG. 3, with the screw spindles, and a further sectional illustration of the pump shown in FIG. 1 and FIG. 2.
Figure 4:
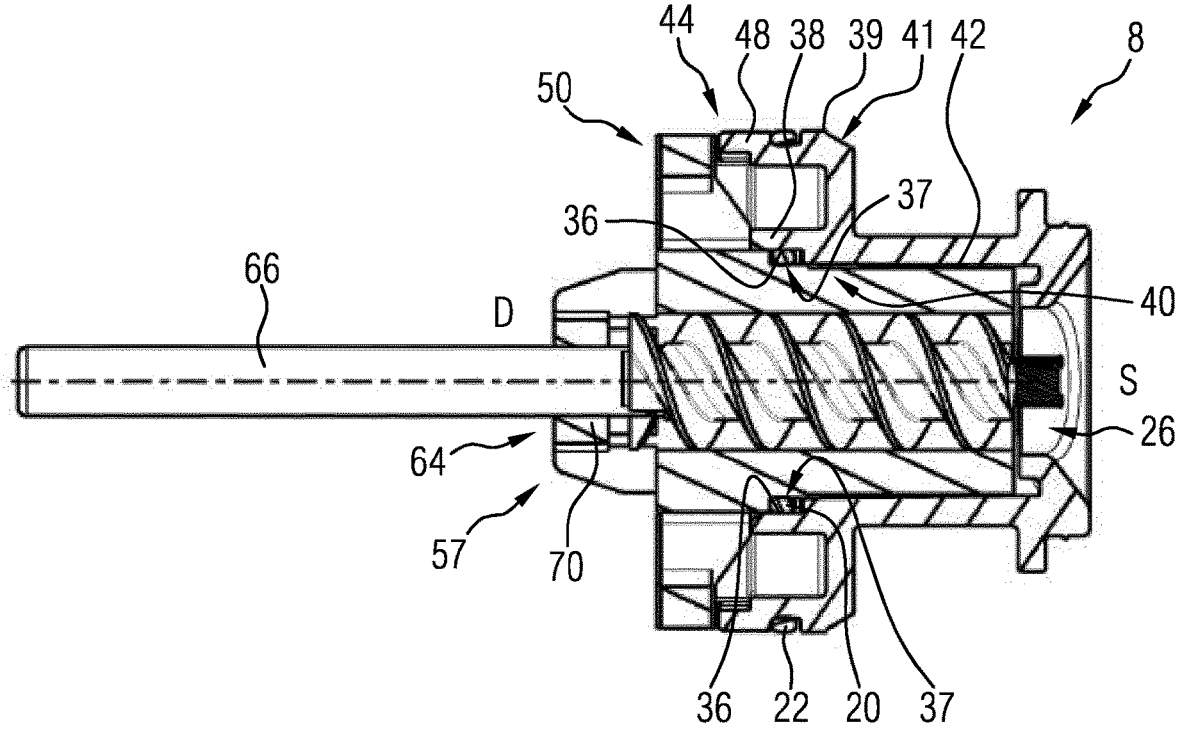

FIG. 1 shows a fuel delivery assembly or a fuel pump 2, which comprises a screw-spindle pump 8 on the suction side 4 and an electric motor 10, driving the screw-spindle pump 8, on the pressure side 6. The interface SS-SS (cf. FIG. 1) between the electric motor 10 and the pump 8 is in this case formed in an offset manner such that a projecting interface section 57 with centering action (cf. FIG. 1 in combination with FIG. 4) of the pump 8 projects as far as possible into the electric motor 10 and is arranged concentrically with respect to the electric motor 10. Here, the centering by the interface section 57 ensures, in combination with a pressure-side abutment section 50, which abuts against the electric motor 10, a statically determined installation position of the pump 8 with respect to the electric motor 10.

The electric motor 10 and a pressure-side region of the pump 8 are in this case rolled together with a sheet-metal casing or sheet-metal cylinder 46, which encapsulates, and at the same time sealingly encloses, the electric motor 10, substantially completely, and said pressure-side region of the pump 8.

Figure 2:
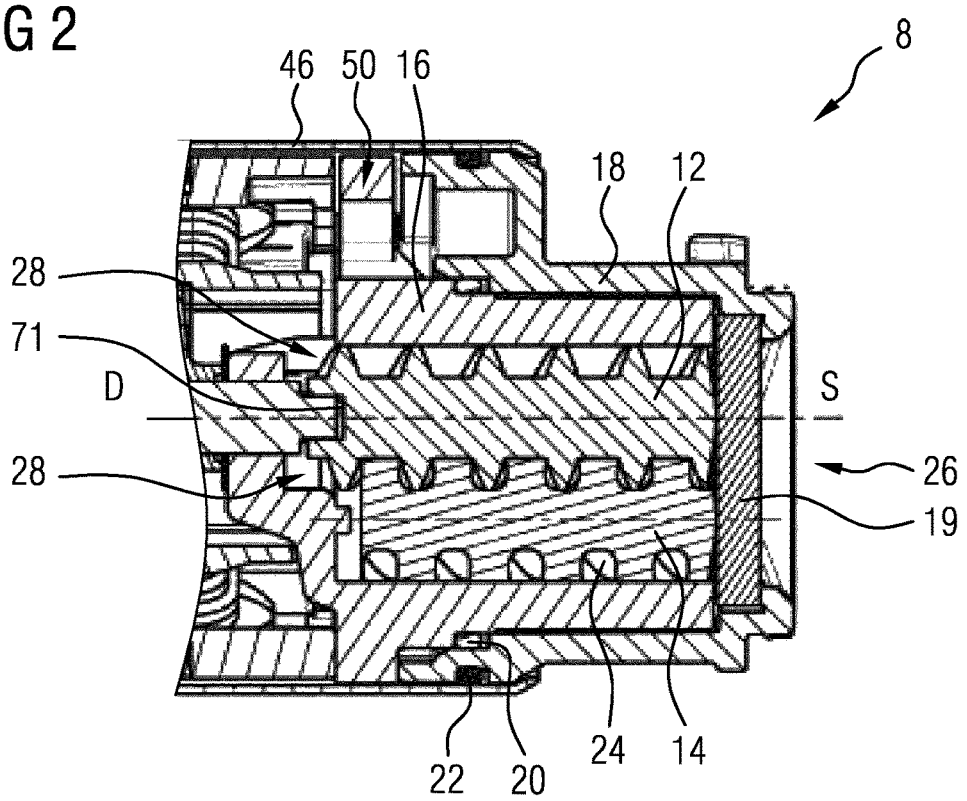
FIG. 2 is a further sectional illustration of the pump shown in FIG. 1.

FIG. 2 illustrates the pump 8, that comprises a drive spindle 12 and a running spindle 14, which runs oppositely with respect to the drive spindle 12. The pump 8 also comprises a pump housing 16 and a pump cover 18 for receiving the two screw spindles 12, 14. Also arranged in the pump cover 18 is an insert 19, which functions as an abutment element and against which the two screw spindles 12, 14 abut for axial run-on.

Here, the two screw spindles 12, 14 form, together with the pump housing 16, delivery chambers 24, which move from a suction side S to a pressure side D of the pump 8 as a consequence of a rotation of the screw spindles 12, 14. Or, put differently, the delivery chambers 24 move in the direction of the pressure side D as a consequence of a rotation of the screw spindles 12, 14

A fuel is delivered by the fuel delivery assembly as described below.

The pump 8 draws a fuel into the delivery chambers 24 via suction-side inlet openings 26 on the pump cover 18, via which delivery chambers the fuel is then delivered as far as the pressure-side outlet openings 28 of the pump housing 16, through which outlet openings said fuel then flows into the electric motor 10. The fuel flows around the rotor 11 of the electric motor 10 and flows further as far as an outlet connection piece 30, via whose outlet opening 32 said fuel finally emerges from the assembly or the pump 2.

Formed on the pump housing 16 on the pressure side D is an offset section 50 functioning as an abutment, or the aforementioned abutment section, which abuts against the electric motor 10. The pump cover 18 in turn abuts with its pressure-side end, which is provided with a planar abutment surface, against the abutment section 50 in a planar manner.

Between the pump housing 16 and the pump cover 18, there is arranged a first radial seal 20, which firstly acts sealingly with respect to the fuel, and secondly centers the pump cover 18 with respect to the pump housing 16 in a floating manner. The radial seal 20 is in this case formed as a round cord ring or O-ring and arranged on an inner side 36 of an inner peripheral, substantially oval projection 38 in the region of the pressure-side end of the pump cover 18 (cf. FIG. 3 in combination with FIG. 2 and FIG. 4). Said projection 38 is offset with respect to an inner side of an adjacent pump cover section 42, which inner side is peripheral in a substantially oval manner. The oval contour of the projection 38 and the oval contour of the inner side of the adjacent pump cover section 42 correspond here approximately to the respectively associated oval sections of the pump housing 16. However, due to the radial seal 20, a radial spacing of the pump cover 18 with respect to the pump housing 16 is ensured.

Here, the aforementioned "oval contour" and the aforementioned "oval sections" are to be understood in the sense of an oval with two ends which, in this embodiment, have mutually different radii. In principle, however, said radii may also be equal.

Here, the pump cover section 42 has a cone or a conicity on the inner side, wherein the inner-side diameter or the inner-side dimensions of the pump cover section 42 is/are reduced or shortened in the direction of the suction side S. Alternatively, the pump cover section 42 may also be formed without such a cone or without such a conicity.

Associated with the inner side of the pump cover section 42 is a correspondingly peripheral outer side of a pump housing section 40, which outer side forms a spacing with respect to the inner side. The outer side of the pump housing section 40 also has a cone or a conicity, wherein the outer-side diameter or the outer-side dimensions of the pump housing section 40 is/are also reduced or shortened in the direction of the suction side S. Here, the spacing due to the radial seal 20 prevents contact between the mutually facing sections 40, 42, and thereby makes possible the floating centering already mentioned above of the pump cover 18 with respect to the pump housing 16. The outer side of the pump housing section 40 may in this case advantageously have a greater conicity, with the result that the spacing increases toward the suction side.

Since, in this exemplary embodiment of the pump 8, the pump housing 16 and pump cover 18 are preferably injection moldings, the mutually facing sides of the pump cover section 42 and the pump housing section 40 advantageously have a slight conicity, so as to facilitate the production as such. In principle, however, this conicity is not absolutely necessary. It is merely necessary for the spacing as such between the pump cover 18 and the pump housing 16 by means of the radial ring 20 to be ensured, so that mutual contacting does not occur.

Arranged with a radial spacing, and so as to be situated outwardly, with respect to the first radial seal 20 on an outer side, or an outer side section 44, of the pump cover 18 is a second radial seal 22 in the form of a radial ring in a peripheral groove provided therefor. The second radial seal 22, which seals off with respect to the fuel, may in this case also be formed as a round cord ring or formed as an O-ring. This section 44, which is formed by an outer peripheral, circular ring-shaped or circular projection 48 of the pump cover 18, is rolled together with the sheet-metal casing 46. Here, the section 44, which comprises a bevel 41 with a rolling edge 39, forms, together with the abutment section 50, the rolling region of the pump 8.

At its pressure-side end, the projection 48 has a planar abutment surface that abuts against the abutment section 50 in a planar manner. The section 44 terminates with a for example 30° bevel 41 on the suction side, against which bevel the sheet-metal casing or sheet-metal cylinder 46 is bent over after the rolling.

Figure 3:
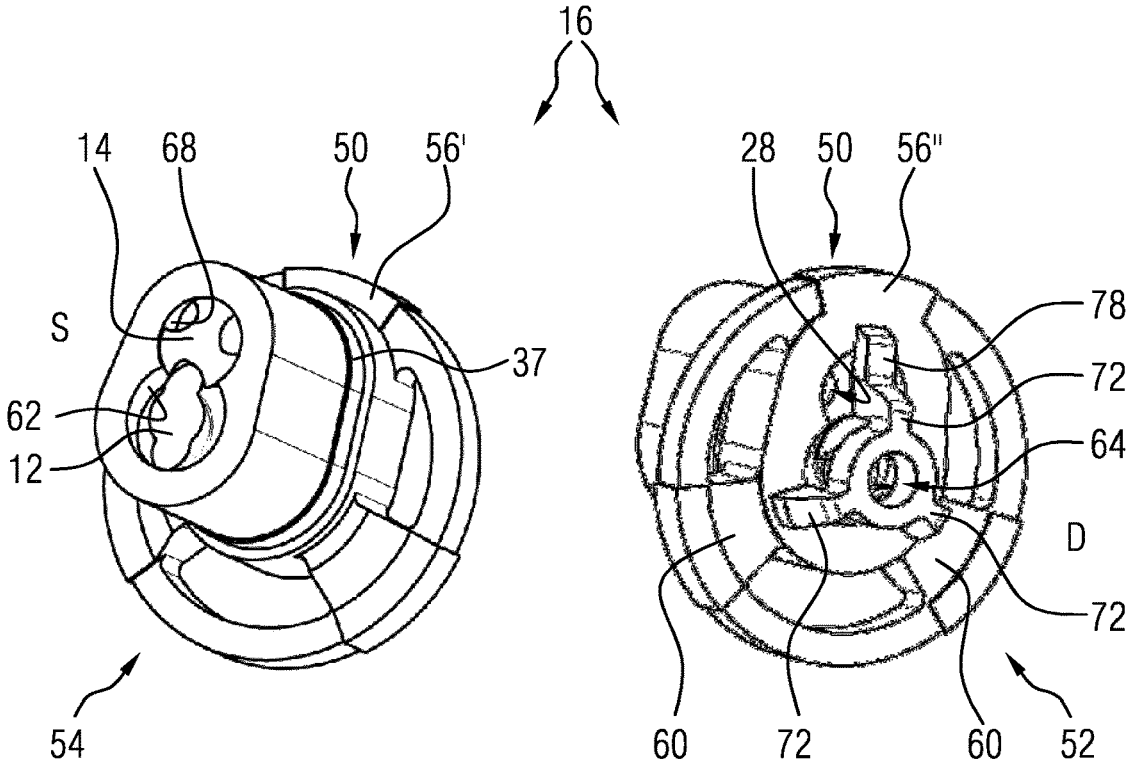
FIG. 3 is a first and a second perspective illustration of the pump housing shown in FIG. 1, with installed screw spindles.
Figure 5:
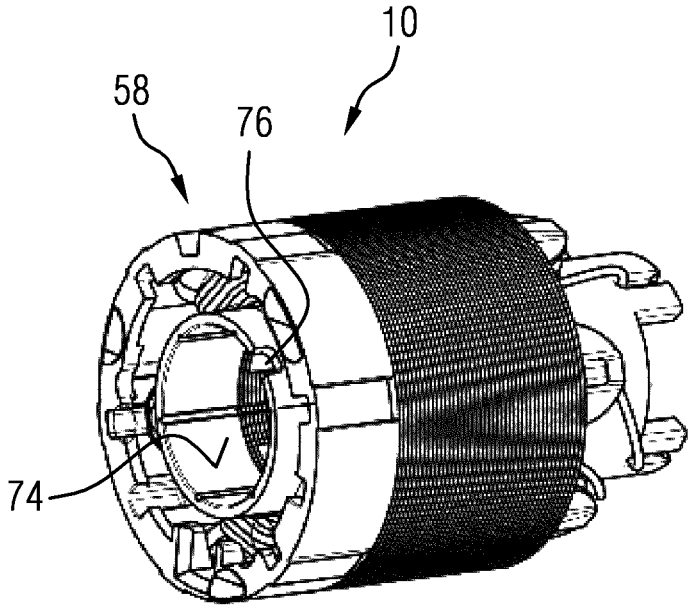
FIG. 5 is a perspective illustration of a stator, shown in FIG. 1, of an electric motor.

On two end sides 52, 54, the abutment section 50 of the pump housing 16, which abutment section is flange-like on the motor side, is formed with planar peripherally extending abutment elements $\mathbf{56}^{I}$, $\mathbf{56}^{II}$, which firstly are abutted against on the suction side by the pump cover 18 with its planar abutment surface, and which secondly abut on the motor side in a planar manner against a stator housing 58 (cf. FIG. 5) of the electric motor 10. Formed here on both end sides 52, 54, in each case so as to be distributed over the periphery, are a total of three projecting planar abutment elements $\mathbf{56}^{I}$, $\mathbf{56}^{II}$ functioning as defined force introduction regions. Here, said abutment elements $\mathbf{56}^{I}$, $\mathbf{50}^{II}$ are advantageously arranged uniformly spaced apart from one another and offset from one another by 120°. The abutment elements $\mathbf{56}^{I}$, $\mathbf{56}^{II}$ on both end sides 52, 54 correspond to one another here with respect to their position (FIG. 3). According to one aspect of the invention, abutment section 50, as mentioned already, is rolled together with the sheet-metal casing 46 or encapsulated by the latter.

Furthermore, the abutment section 50 is of circular ring-shaped form and is formed on the core of the pump housing 16, which core is situated inwardly with respect to the abutment section 50, via an inner rib collar with a total of three ribs 60. The abutment section 50 is also arranged concentrically relative to a part-cylindrical receptacle 62 for the drive spindle 12 and a cylindrical receptacle 64 for a rotor shaft, or a rotor shaft section 66, of the electric motor 10 as shown in FIG. 3 in combination with FIG. 4. By contrast, the abutment section 50 is arranged eccentrically relative to a part-cylindrical receptacle 68 for the running spindle 14. In this way, the total of three ribs 60, which are arranged around the periphery uniformly spaced apart from one another and offset from one another by 120° and which are formed between the abutment section 50 and the core of the pump housing 16, are not formed consistently in terms of length.

The interface section 57 mentioned already at the beginning, which is offset with respect to the core of the pump housing 16 and the abutment section 50, is also formed with the receptacle 64 on the pump housing 16 on the pressure side, the rotor shaft 66 being inserted into said receptacle for the purpose of the coupling to the drive spindle 12. The receptacle 62 is furthermore offset with respect to the receptacle 64 (cf. FIG. 4). Here, in addition to the bearing point 70, it is possible for the rotor shaft 66 to be coupled to the drive spindle 12 via a coupling (not illustrated here), for example in the form of an Oldham coupling—which is known as such to a person skilled in the art. The coupling may in this case be arranged in the receptacle 64 or in the receptacle 62 so as to bear against a shoulder shown in FIG. 4. In this case, the coupling would at any rate be arranged on the suction side with respect to the bearing point 70.

The interface section 57 extends from the core of the pump housing 16 into the stator housing 58. An outer rib collar, with a total of three centering ribs 72, is formed on said interface section 57, which centering ribs extend into a centering seat 74 of the stator housing 58. Here, said centering ribs 72 are arranged uniformly spaced apart from one another and offset from one another by 120°. A stepped orientation rib section 78 for the angular orientation of the pump housing 16 with respect to the stator housing 58 is formed on one of said ribs 72 in a radial direction. Here, said orientation rib section 78 engages into a corresponding recess 76 of the centering seat 74.

The screw spindle pump 8 is joined to the electric motor 10 as follows:

The pump housing 16, together with the screw spindles 12, 14, is coupled to the electric motor 10. Firstly, the pump housing section 57 engages with its outer rib collar or its formed-on three centering ribs 72 into the centering seat 74 of the electric motor 10. Secondly, the rotor shaft 66 engages, by means of two plane-parallel carrier surfaces, into a groove-like section 71 of the drive spindle 12 via a bearing point 70 (cf. FIG. 4). In the case of a coupling (not illustrated here,) which may be connected to the drive spindle 12 and arranged on the motor side in a corresponding receptacle 64 of the pump housing section 57, the rotor shaft 66 engages, by the two plane-parallel carrier surfaces, into the groove-like section 71 of the drive spindle 12 via the bearing point 70 and said coupling.

The pump housing 16 is oriented in a peripheral direction with respect to the stator housing 58 by the orientation rib section 78, which is formed on one of the three ribs. During the joining, the abutment section 50 furthermore abuts against the stator housing 58 by the abutment elements $\mathbf{56}^{II}$.

Prior to the joining of the pump cover 18 to the pump housing 16, the first sealing ring 20 is pulled onto the pump housing-side seat 37. Furthermore, the second sealing ring 22 is placed into the groove of the pump cover 18 that is peripheral on the outer side thereof. The sealing ring 20 is subsequently wetted with a lubricant. The pump cover 18 is then joined to the pump housing 16. Here, the pump cover 18 abuts with its planar abutment surface against the abutment section 50 or against the planar abutment elements $\mathbf{56}^{I}$ of the latter.

By way of the sealing ring 20, the pump cover 18 is centered in a floating manner with respect to the pump housing 16. Subsequently, an axial preload is applied to the arrangement of the electric motor 10 and the pump stage 8 to retain the floating centering of the pump cover 18. Afterwards, the arrangement is rolled together with the sheet-metal casing 46, whereby the floating centering is fixed.

Prior to the rolling of the sheet-metal casing 46, the arrangement of the two sealing rings 20, 22 acts according to a centering in a manner floating with double and serial action, that is to say firstly acting so as to center in a floating manner with respect to the pump cover 18, and secondly acting so as to center in a floating manner with respect to the sheet-metal casing 46. After the rolling, the second radial seal or the second sealing ring 22 acts only sealingly with respect to the delivered fuel. With respect to the sealing action with respect to the fuel, the arrangement of the two sealing rings 20, 22 acts as a seal arrangement with parallel action.

According to an alternative configuration, the second sealing ring 22 is dispensed with. In this case, while being rolled together with the sheet-metal casing 46, the edge 39 of the 30° bevel 41, over which the sheet-metal casing 46 is bent, is deformed such that this deformation as such seals off with respect to the fuel.

Figure 6:
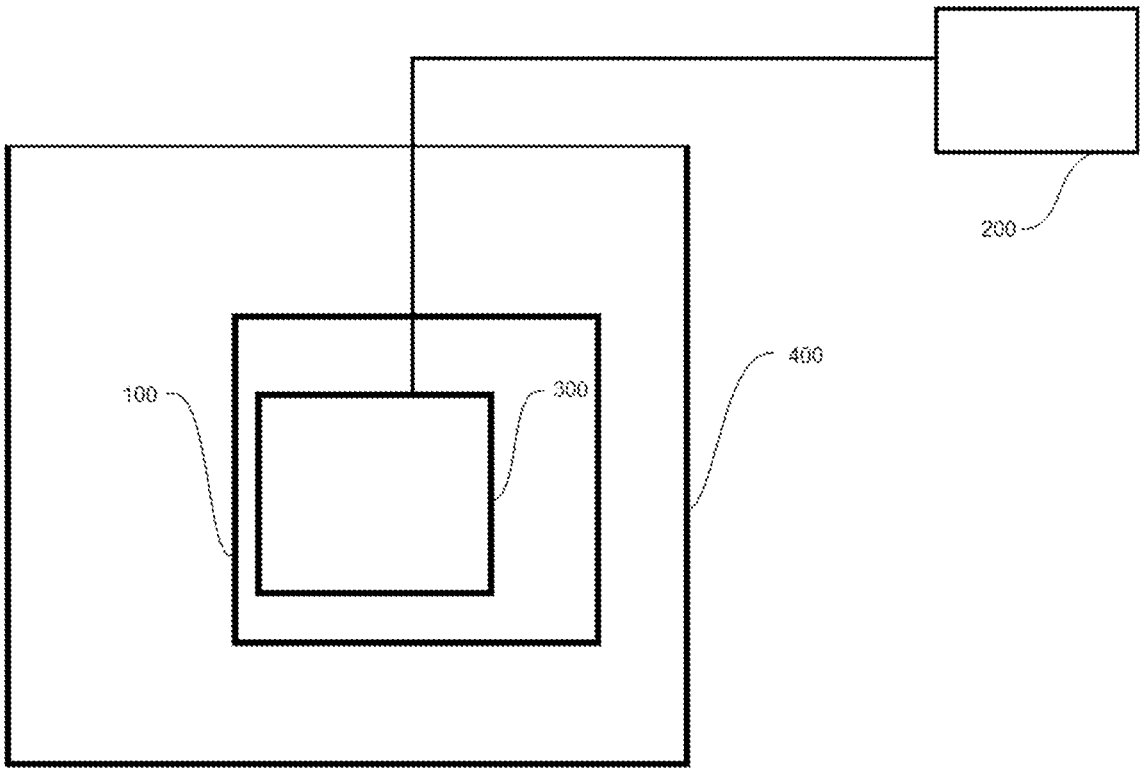
FIG. 6 shows a fuel delivery unit for use in a fuel tank of a vehicle.

FIG. 6 shows a fuel delivery unit 300 comprises at least the fuel pump 2, which comprises the screw-spindle pump 8 on the suction side 4 and an electric motor 10, driving the screw-spindle pump 8, on the pressure side 6. The fuel delivery unit 300 is arranged in a swirl pot 100 in order for fuel to be delivered from the swirl pot to an internal combustion engine 200 from a fuel tank 400.

Although exemplary embodiments have been discussed in the above description, it should be noted that numerous modifications are possible. Furthermore, it should be noted that the exemplary embodiments are merely examples which are not intended to limit the scope of protection, the applications and the structure in any way. Rather, a person skilled in the art will take from the above description a guideline for implementation of at least one exemplary embodiment, wherein various modifications may be made, in particular with regard to the function and arrangement of the described components, without departing from the scope of protection as can be gathered from the claims and equivalent feature combinations.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto

The invention claimed is:

1. A screw spindle pump comprising at least two screw spindles, comprising:

a drive spindle; and a running spindle that runs oppositely with respect to the drive spindle;

a pump housing configured to receive the at least two screw spindles;

wherein the at least two screw spindles and at least the pump housing form delivery chambers, which move from a suction side of the pump to a pressure side of the pump due to a rotation of the screw spindles;

an offset interface with centering action is provided on the pressure side of the pump housing for a statically determined coupling to an electric motor;

an offset pressure-side abutment section functioning as an abutment is formed on the pressure side of the pump housing, which is configured to abut against the electric motor for application of an axial preload;

a sheet-metal casing, which forms a rolling region of the pump, encapsulates, and at the same time sealingly encloses, at least one pressure region of the pressure-side abutment section, which is close to an interface during a rolling;

wherein the at least two screw spindles, together with a portion pump housing that radially surrounds the at least two screw spindles, at least partially project from the rolling region of the pump on the suction side, wherein the pressure-side abutment section is of circular ring-shaped form and is formed on a core of the pump housing via an inner rib collar with multiple ribs.

2. The screw spindle pump as claimed in claim 1, further comprising:

a pump cover, which abuts against the pressure-side abutment section of the pump housing, wherein the pressure-side abutment section forms, in combination with a pressure region of the pump cover, which is close to the interface and, during a rolling, is encapsulated, and at the same time sealingly enclosed, with the pressure-side abutment section by the sheet-metal casing, the rolling region of the pump.

3. The screw spindle pump as claimed in claim 2, further comprising:

a first radial seal arranged between the pump housing and the pump cover and configured to:

provide sealing with respect to a delivery medium, and center the pump cover with respect to the pump housing in a floating manner.

4. The screw spindle pump as claimed in claim 3, wherein a second radial seal is arranged with a radial spacing, to be situated outwardly, with respect to the first radial seal, which is arranged on an inner side of the pump cover, on an outer side of the pump cover, which outer side is able to be rolled together with a sheet-metal casing.

5. The screw spindle pump as claimed in claim 4, wherein the first radial seal is arranged on an inner side of an inner peripheral projection of the pump cover.

6. The screw spindle pump as claimed in claim 5, wherein the second radial seal is arranged on an outer side of an outer peripheral projection of the pump cover.

7. The screw spindle pump as claimed in one of claim 4, wherein at least one of the first and the second radial seal is formed as a round cord ring or an O-ring.

8. The screw spindle pump as claimed in claim 3, wherein the first radial seal is arranged within a region of the pump that is to be rolled together with the sheet-metal casing.

9. The screw spindle pump as claimed in claim 2, wherein at least one of the pump housing and the pump cover is formed as an injection molding.

10. The screw spindle pump as claimed in claim 1, wherein, on at least one end side of the pressure-side abutment section, there is at least one projecting abutment element.

11. The screw spindle pump as claimed in claim 10, wherein respective abutment elements are provided on two end sides of the pressure-side abutment section.

12. The screw spindle pump as claimed in claim 11, wherein at least three abutment elements are formed so as to be distributed over a periphery of the pressure-side abutment section.

13. The screw spindle pump as claimed in claim 12, wherein, with respect to an end side, the abutment elements are uniformly spaced apart from one another, wherein the abutment elements on both end sides correspond to one another with respect to their position.

14. The screw spindle pump as claimed in claim 10, wherein the at least one projecting abutment element is planar in a peripheral direction.

15. A screw spindle pump, comprising:

at least two screw spindles, comprising:

a drive spindle; and a running spindle that runs oppositely with respect to the drive spindle;

a pump housing configured to receive the at least two screw spindles;

wherein the at least two screw spindles and at least the pump housing form delivery chambers, which move from a suction side of the pump to a pressure side of the pump due to a rotation of the screw spindles;

an offset interface with centering action is provided on the pressure side of the pump housing for a statically determined coupling to an electric motor;

an offset pressure-side abutment section functioning as an abutment is formed on the pressure side of the pump housing, which is configured to abut against the electric motor for application of an axial preload;

a sheet-metal casing, which forms a rolling region of the pump, encapsulates, and at the same time sealingly encloses, at least one pressure region of the pressure-side abutment section, which is close to an interface during a rolling;

wherein the at least two screw spindles, together with a portion pump housing that radially surrounds the at least two screw spindles, at least partially project from the rolling region of the pump on the suction side; and an outer rib collar, with at least two centering ribs, is formed on a projecting interface section having a centering action and configured for insertion into a centering seat of the electric motor.

16. The screw spindle pump as claimed in claim 15, wherein an offset orientation rib section for an angular orientation of the pump housing with respect to the electric motor is formed on one of the centering ribs in a radial direction, wherein the offset orientation rib section is configured for insertion into a corresponding recess of the centering seat.

17. A fuel delivery assembly comprising:

an electric motor; and a screw-spindle pump comprising at least two screw spindles, comprising:

a drive spindle; and a running spindle that runs oppositely with respect to the drive spindle;

a pump housing configured to receive the at least two screw spindles;

wherein the at least two screw spindles and at least the pump housing form delivery chambers, which move from a suction side of the pump to a pressure side of the pump due to a rotation of the screw spindles;

an offset interface with centering action is provided on the pressure side of the pump housing for a statically determined coupling to an electric motor;

an offset pressure-side abutment section functioning as an abutment is formed on the pressure side of the pump housing, which is configured to abut against the electric motor for application of an axial preload;

a sheet-metal casing, which forms a rolling region of the pump, encapsulates, and at the same time sealingly encloses, at least one pressure region of the pressure-side abutment section, which is close to the interface during a rolling;

wherein the at least two screw spindles, together with a portion pump housing that radially surrounds the at least two screw spindles, at least partially project from the rolling region of the pump on the suction side;

wherein the screw-spindle pump is driven by the electric motor; and wherein an installation position of the pump with respect to the electric motor is statically determined, wherein the pressure-side abutment section is of circular ring-shaped form and is formed on a core of the pump housing via an inner rib collar with multiple ribs.

18. The fuel delivery assembly as claimed in claim 17, wherein the electric motor and the screw-spindle pump are rolled together with a sheet-metal casing, which encapsulates the electric motor completely and the pump stage only partially.

19. A fuel delivery unit for use in a fuel tank of a vehicle, comprising:

an electric motor; and a screw-spindle pump comprising at least two screw spindles, comprising:

a drive spindle; and a running spindle that runs oppositely with respect to the drive spindle;

a pump housing configured to receive the at least two screw spindles;

wherein the at least two screw spindles and at least the pump housing form delivery chambers, which move from a suction side of the pump to a pressure side of the pump due to a rotation of the screw spindles;

an offset interface with centering action is provided on the pressure side of the pump housing for a statically determined coupling to an electric motor;

an offset pressure-side abutment section functioning as an abutment is formed on the pressure side of the pump housing, which is configured to abut against the electric motor for application of an axial preload;

a sheet-metal casing, which forms a rolling region of the pump, encapsulates, and at the same time sealingly encloses, at least one pressure region of the a pressure-side abutment section, which is close to an interface during a rolling;

wherein the at least two screw spindles, together with a portion pump housing that radially surrounds the at least two screw spindles, at least partially project from the rolling region of the pump on the suction side;

wherein the screw-spindle pump is driven by the electric motor; and wherein an installation position of the pump with respect to the electric motor is statically determined, wherein the pressure-side abutment section is of circular ring-shaped form and is formed on a core of the pump housing via an inner rib collar with multiple ribs; and a swirl pot in which the electric motor and the screw-spindle pump are arranged for fuel to be delivered from the swirl pot to an internal combustion engine.

* * * * *